United States Patent [19]

Anhalt et al.

[11] Patent Number: 4,588,244

[45] Date of Patent: May 13, 1986

[54] LINEAR ACTUATED CONNECTOR

[75] Inventors: John W. Anhalt, Orange; George R. Deacon, Corona Del Mar, both of Calif.

[73] Assignee: ITT Corporation, New York, N.Y.

[21] Appl. No.: 690,915

[22] Filed: Jan. 14, 1985

[51] Int. Cl.[4] ..... H01R 13/631

[52] U.S. Cl. ..... 339/75 M; 339/74 R

[58] Field of Search ..... 339/75 M, 74 R, 75 MP, 339/42

[56] References Cited

U.S. PATENT DOCUMENTS

| | | | |
|---|---|---|---|
| 3,594,698 | 7/1971 | Anhalt | 339/75 M |
| 3,754,205 | 8/1973 | Lenkey | 339/42 |
| 3,839,697 | 10/1974 | Obert | 339/42 |
| 4,026,623 | 5/1977 | Goodman et al. | 339/75 M |
| 4,094,570 | 6/1978 | de Barros | 339/75 M |

OTHER PUBLICATIONS

IBM Technical Disclosure Bulletin, vol. 13, No. 6, 11/1970 "Socket Connector"; Brain, M. L.

*Primary Examiner*—John McQuade

*Attorney, Agent, or Firm*—T. L. Peterson; R. C. Turner

[57] ABSTRACT

An improvement is described in a type of connection system wherein an insertable circuit assembly can be pushed into a housing which contains an inplace circuit assembly, until terminals on the two assemblies lie opposite one another but out of contact, at which time a deflecting member on one of the assemblies is moved sidewardly to deflect its terminals into contact with the other terminals. In the present system the inplace assembly is movable along with the insertable assembly after they engage one another. As the assemblies move, a cam on the housing moves the deflecting member sidewardly to deflect the terminals.

6 Claims, 5 Drawing Figures

BEFORE FULL ENGAGEMENT

AFTER FULL ENGAGEMENT

LINEAR ACTUATED CONNECTOR

BACKGROUND OF THE INVENTION

Modular circuit assemblies such as in the form of a drawer containing one or more circuit boards, can be connected to other circuitry in a housing by inserting the circuit assembly into the housing in the manner of pushing in a drawer. Connection is then made between contacts, or terminals, on the insertable circuit assembly, with corresponding contacts or terminals of an inplace circuit assembly that lies within the housing. It would be possible to position the terminals of the two assemblies so that they wipe across one another to make contact as the insertable assembly is initially pushed into engagement with the inplace assembly. However, it would require relatively large terminals to assure that accurate contact is made, which would minimize the allowable number of terminals and increase the contact wear and insertion forces.

To avoid such problems, multiple small terminals have been used which move into positions adjacent and opposite one another but out of direct contact when the insertable circuit assembly is pushed into the housing. Direct contact of the terminals is achieved by deflecting the terminals on one assembly laterally into contact with the terminals on the other assembly. U.S. Pat. No. 3,853,379 by Goodman, which is assigned to the same assignee as the present application, is an example of a system wherein the terminals are sidewardly deflected after the circuit assemblies engage one another.

The sideward deflection of the terminals after the circuit assemblies are engaged, has been accomplished by the use of mechanisms that were manually operable by moving a lever or the like located outside the housing after the insertable assembly had been fully inserted. Such manually operable terminal-deflecting mechanisms have various disadvantages, including the fact that they require a separate manual operation and they require space for a mechanism that is manually operated at the front of the housing, a rod extending to the rear, and a device at the rear for deflecting the terminals. A system that minimized the manual steps required to install a circuit assembly and which minimize the required space, while still permitting contact of terminals only after the insertable assembly engaged the inplace assembly, would be of considerable value.

SUMMARY OF THE INVENTION

In accordance with one embodiment of the present invention, a system is described for connecting the terminals of an insertable circuit assembly to the terminals of an inplace circuit assembly that lies within a housing, which enables the deflection of the terminals of one assembly against those of the other only after the assemblies are engaged, wherein the system uses a compact mechanism that is operated in a very simple manner. The inplace assembly is movable within the housing, and is pushed in after engagement with the inwardly-pushed insertable assembly after they are engaged. Further movement of the two assemblies deeper into the housing results in a cam follower on one of the assemblies being moved by a cam that is mounted on the housing. The cam follower moves a deflecting member that deflects the terminals on one assembly against the terminals of the other assembly.

The novel features of the invention are set forth with particularity in the appended claims. The invention will be best understood from the following description when read in conjunction with the accompanying drawings.

DESCRIPTION OF THE PREFERRED EMBODIMENTS

Figure 1A:
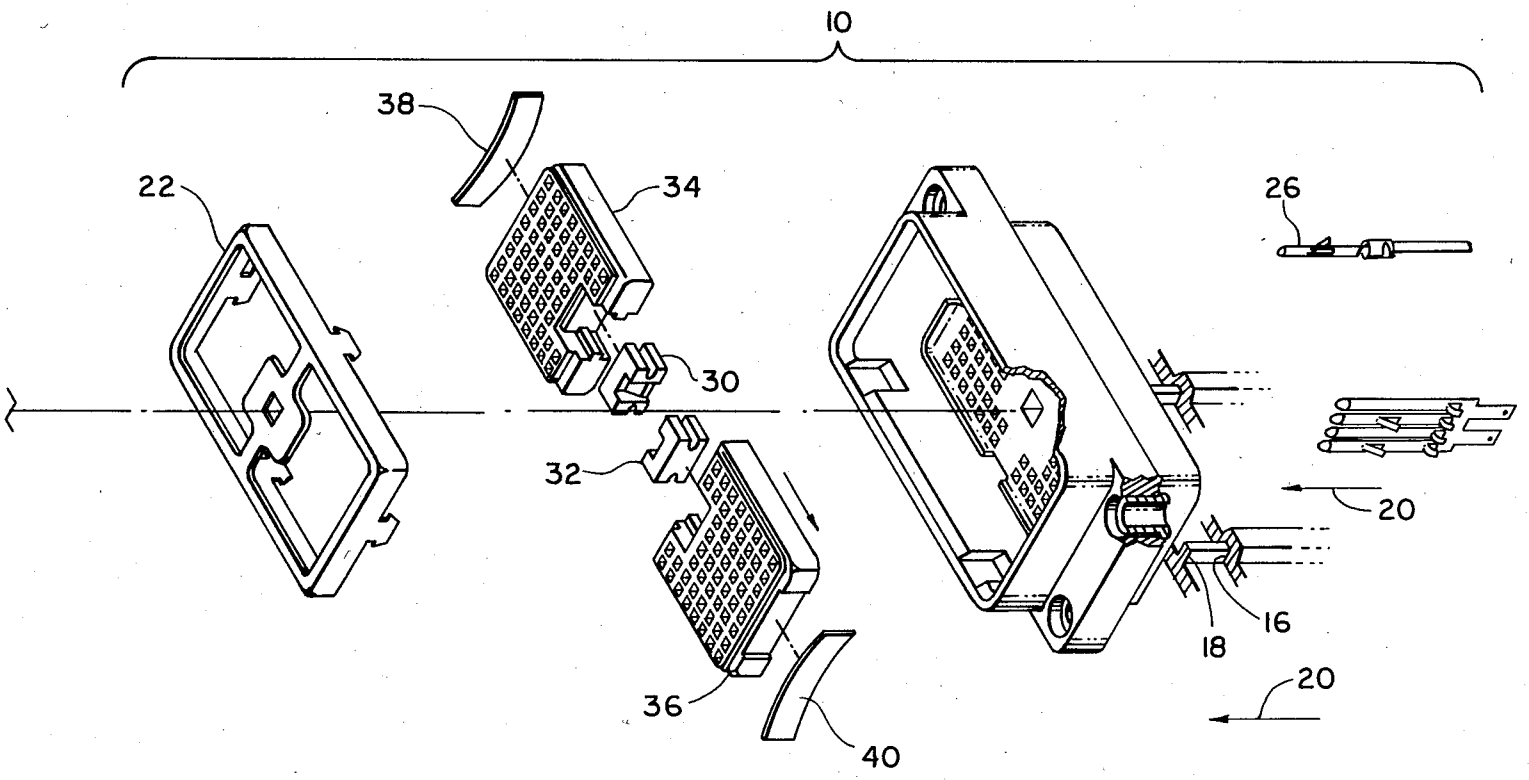
FIG. 1A is an exploded perspective view of an insertable circuit assembly of a circuit connection system constructed in accordance with one embodiment of the present invention.
Figure 1B:
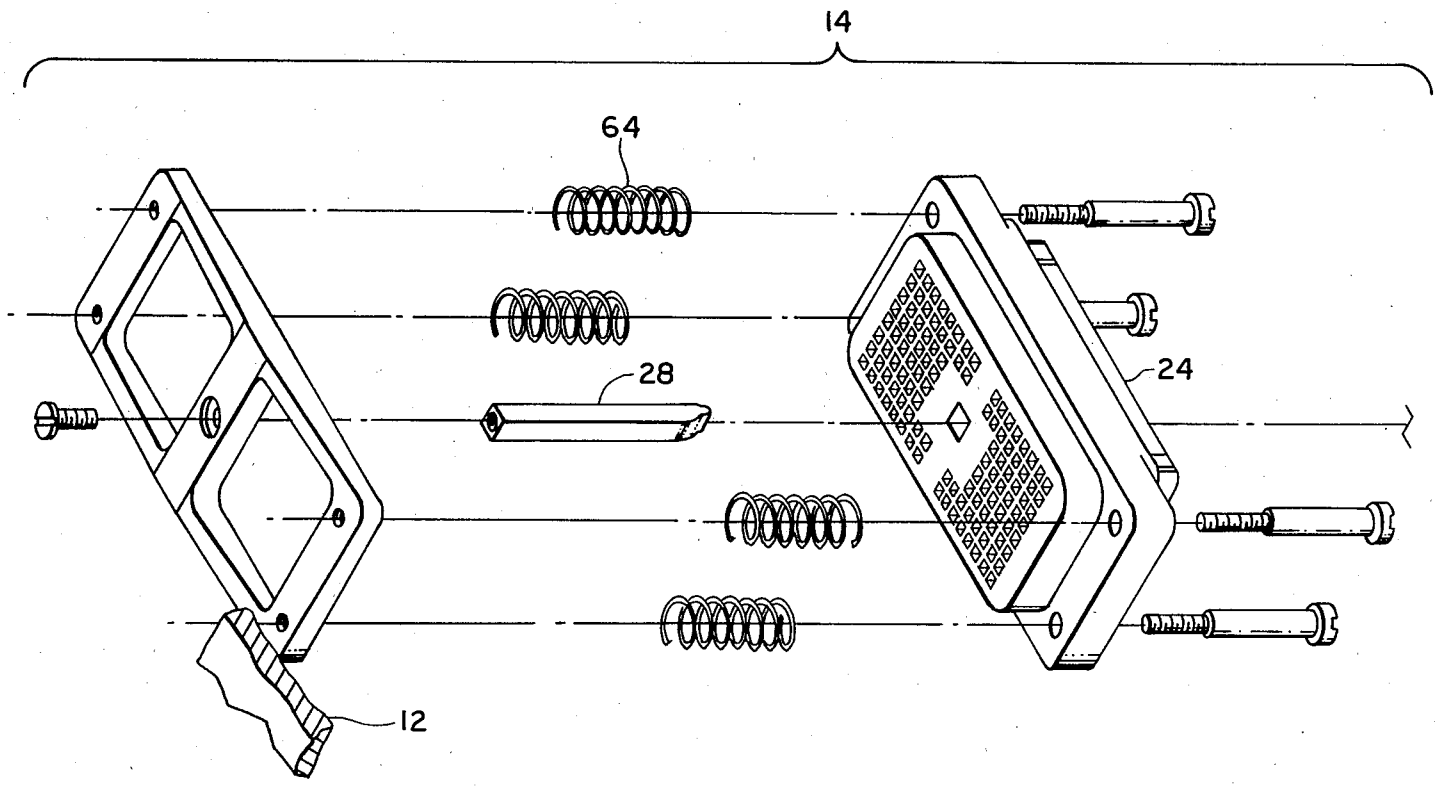
FIG. 1B is an exploded perspective view of an inplace circuit assembly of the circuit connection system constructed in accordance with one embodiment of the present invention.

FIGS. 1A and 1B illustrates a system which includes an insertable circuit assembly 10 that can be inserted into a housing 12 to connect to an inplace circuit assembly 14 that normally always lies within the housing. The insertable assembly 10 has grooves 16 which receive guides 18 on the housing, to guide the insertable assembly in sliding movement along a first or insertion direction 20 to move progressively deeper into the housing. During such insertion, an abutting surface 22 of the insertable assembly abuts a corresponding abutting surface 24 on the inplace assembly. Contact of the corresponding terminals is accomplished by pushing the insertable assembly even further into the housing, so it pushes the inplace assembly 14 along with it deeper into the housing. This results in a cam 28 that is fixed to the housing, more fully engaging a pair of cam followers 30, 32 of the insertable assembly. The cam followers push deflecting members 34, 36 in opposite directions, against the force of leaf springs 38, 40 to deflect the terminals 26. Of course, the cam followers can be formed as surfaces of the terminal-deflecting members 34, 36 instead of as separate members.

Figure 2:
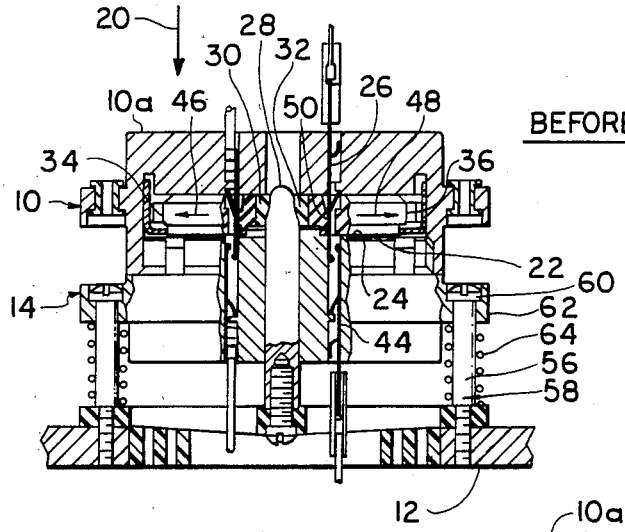
FIG. 2 is a sectional view of the assemblies of FIG. 1, shown with the assemblies engaged but with the terminals out of contact with one another.
Figure 3:
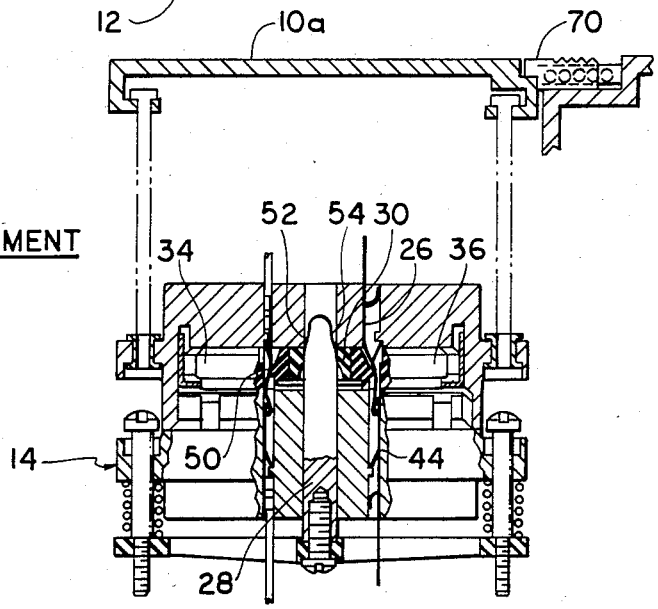
FIG. 3 is a view similar to that of FIG. 2, but with the assemblies in a fully connected position wherein the terminals are in contact.

FIG. 2 illustrates the system at a time when the insertable assembly 10 has been inserted just far enough for the abuttable surfaces 22, 24 to engage one another. It can be seen that with the insertable assembly in its abutting location, the outer end portions of the multiple terminals 26 of the insertable assembly lie adjacent, beside, and opposite the outer end portions of the multiple terminals 44 of the inplace assembly. The cam 28 has reached the cam followers 30, 32 but has not deflected them along opposite lateral second directions 46, 48. Accordingly, terminal-engaging portions such as 50 on the deflecting members 34, 36 have not yet been moved to deflect the terminals 26 laterally (perpendicular to arrow 20). Further movement of the insertable assembly 10 in the insertion direction 20 results in the assemblies 10, 14 moving to the fully inserted position shown in FIG. 3. In that position, camming surfaces 52, 54 on the cam 28 have passed across the cam followers, to push them laterally so they push the terminal deflecting members 34, 36 to deflect the free end portions 50 of the terminals. The terminals 26 on the insertable assembly are therefore engaged with the terminals 44 of the inplace assembly.

The inplace assembly 14 is guided in sliding movement in the insertion direction by its sliding engagement with guides 56 (FIG. 2) formed on a group of screws 58 mounted on the housing 12. The outer ends 60 of the screws abut the frame 62 of the inplace assembly to limit movement of the inplace assembly in a forward direction opposite to the rearward or insertion direction 20. Coil springs 64 extending between the inplace assembly 14 and the housing 12 urge the inplace assembly to move in a forward direction opposite to the insertion direction. The springs have a low spring rate and preload so that only a small force is required to push in the assemblies. Where it is not desired to have handles on the outer end 10*a* of the insertable assembly, then the springs press out the assembly so that it can be easily grasped to pull out when released to do so. When the insertable assembly is fully inserted, a spring-operated catch 70 (FIG. 3) latches the assembly in place.

The use of an elongated cam 28 with one end fastened to the housing directly behind the assemblies, and with a free forward end positioned to engage the two cam followers, results in several advantages. One advantage in some situations is that the camming mechanism does not occupy any space at the sides of the assemblies, so that the insertable assemblies, which are usually in the form of drawers, can be closely spaced. The fact that the cam engages two cam followers which press in opposite directions, minimizes sideward bending of the cam and sideward deflection of the inward end of the insertable assembly, since the forces of opposite sides of the cam and insertable assembly cancel out one another. A major advantage is, of course, that the insertable assembly can be fully inserted and the terminals connected merely by pushing the insertable assembly all the way into the housing.

Removal of the insertable assembly is accomplished by operating the latch 70, the insertable assembly then moving partially out by itself. This arrangement avoids the possibility that an insertable assembly might be inserted all of the way, but an operator might forget to move a manually operated mechanism required to deflect the terminals into contact. No one has to show the operator how and at what time during installation to operate such a mechanism. The terminals do not become "set" by being deflected when no other terminals are present to limit bending. The fact that the cam enters the middle of the insertable assembly, permits deflection of the terminals on the insertable assembly, while avoiding the need for cam followers or the like that project from the sides of the insertable assembly, so that only the extreme end of the insertable assembly has to be protected during transport, as by a cover.

Figure 4:
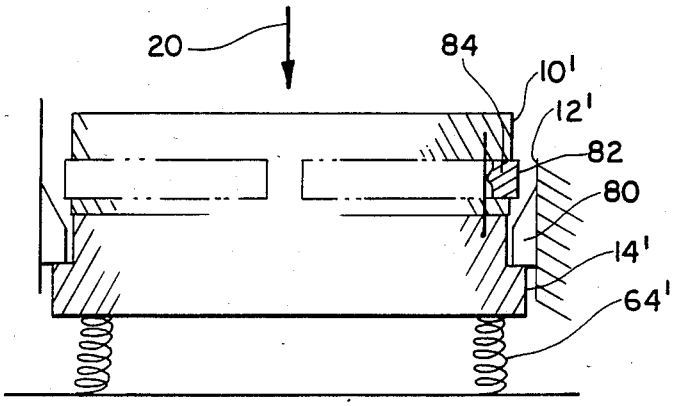
FIG. 4 is a partial simplified view of a system constructed in accordance with another embodiment of the invention.

FIG. 4 illustrates another embodiment of the invention, wherein a cam 80 mounted on the housing 12' engages a cam follower surface 82 on a terminal-deflecting member 84. As the insertable assembly 10' is inserted into the housing, and it engages the inplace assembly 14', and the insertable assembly is pushed in against the force of springs 64', the cam 80 deflects the deflecting member 84 laterally to press the terminals into contact.

Thus, the invention provides an improved system of the type wherein an insertable member can be inserted into a housing into engagement with an inplace assembly within the housing, until terminals on these two assemblies lie opposite but out of contact with each other, and which can then deflect half of the terminals into contact with the others. The improved system permits deflection of the terminals without the need to separately operate mechanisms to deflect the terminals, but instead enables terminal deflection merely by continuing to push the insertable assembly all the way into the housing. This is accomplished by mounting the inplace connector so that it can move deeper into the housing after it is engaged by an abutting surface of the insertable assembly. As the two assemblies move together into the housing, a cam on the housing causes lateral deflection of a terminal-deflecting member by deflecting a cam follower.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A system for enabling the sliding insertion of an insertable electrical circuit assembly into engagement with an inplace assembly that lies in a housing, so the multiple electrical terminals in each assembly make secure contact with each other, comprising:

a housing;

first and second assemblies, each having a multiplicity of contact terminals, one of said assemblies being an insertable assembly and the other being an inplace assembly, said inplace assembly being movable within said housing;

means for guiding the insertable assembly in sliding movement along a first direction toward and substantially against the inplace assembly, said contacts on each assembly lying adjacent and opposite each other but out of contact when said assemblies are first brought against each other, said inplace assembly being moveable by movement of said insertable assembly after said assemblies are substantially against each other;

the first of said assemblies having a terminal-deflecting member with multiple terminal-engageable portions and a cam follower which can slide in a second direction that is largely perpendicular to said first direction to push said terminal-deflecting member so its terminal-engaging portions deflect a plurality of the terminals of said first assembly in said second direction towards terminals of the second assembly; and a cam coupled to said housing, which engages said cam follower and pushes it in said second direction when said insertable assembly moves further along said first direction, after reaching a position at which said terminals in said assemblies lie adjacent and opposite but out of contact, to deflect a plurality of said terminals of said first assembly into engagement with terminals of said second assembly.

2. The system described in claim 1 wherein:

said second assembly comprises said inplace assembly and includes a frame slideably mounted in said housing so that said frame can slide along said first direction with said insertable assembly when they are engaged, and including means biasing said frame in a direction opposite to said first direction.

3. In a system which includes two circuit assemblies including an insertable assembly that can be inserted into a housing to slide along a first direction to an abutting location wherein abutting surfaces on the assemblies abut, at which time terminals on the insertable assembly lie opposite corresponding terminals of the other, inplace assembly that lies within the housing, the improvement of means for moving a deflecting member on a first of the assemblies along a second direction which is largely perpendicular to said first direction to deflect a set of terminals on said first assembly against the corresponding terminals of the other second assembly comprising:

means for supporting said insertable assembly in movement within said housing up to and past said abutting location;

a cam follower moveably mounted on said first assembly and forming part of it;

a cam mounted on said housing at a location to engage said cam follower and move it to move said deflecting member along said second direction, only when the insertable assembly slides along said first direction past the abutting location; and means for urging said inplace assembly toward a location where it abuts the insertable assembly at said abutting location, and for moveably supporting said inplace assembly on said housing so said inplace assembly can be moved largely along said first direction with said insertable assembly as said insertable assembly is pushed further along said first direction than said abutting location, to enable said cam follower to further approach said cam, whereby to enable deflection of terminals on the first assembly merely by continuing to push the insertable assembly into the housing.

4. The improvement described in claim 3 wherein:

said first assembly forms said insertable assembly, and includes an additional deflecting member and an additional cam follower, said cam followers positioned to move said deflecting members in directions including said second direction and an opposite third direction;

said second assembly forms said inplace assembly and has a hole in it, and said cam is an elongated member having an inner end fixed to said housing and an outer end that projects through said hole and engages both of said cam followers to push them in said opposite directions.

5. A system for enabling a first circuit assembly to be inserted into a housing and into electrical connection with a second circuit assembly that lies within the housing comprising:

a housing;

an inplace circuit assembly which is disposed within said housing and which includes a multiplicity of electrical terminals;

an insertable assembly which includes a multiplicity of electrical terminals that each correspond to the terminals of said inplace assembly;

means for guiding said insertable assembly in sliding movement in an insertion direction within said housing toward said inplace assembly:

said assemblies having abutting surfaces which abut one another when said insertable assembly is slid into said housing to a preliminary position, with corresponding terminals of said assemblies lying opposite each other but out of engagement when said insertable assembly is in said preliminary position;

said inplace assembly is slideably mounted on said housing to move along said insertion direction, but said system includes at least one spring coupled to said inplace assembly to resist movement of said inplace assembly in said insertion direction, to thereby assure that said abutting surfaces abut when said second assembly moves in said first direction;

said first assembly includes a deflecting member moveable in a second direction therein that is substantially perpendicular to said insertion direction, against a plurality of the terminals of the insertable assembly to deflect them against corresponding terminals of said inplace assembly when the abutting surfaces of the assemblies abut, and said deflecting member includes a cam follower which can move said deflecting member in said second direction;

said system includes a cam mounted on said housing and positioned to engage said cam follower to move it in a direction to push said deflecting member in said second direction as said insertable assembly moves in said insertion direction after abutting said second assembly.

6. The system described in claim 5 wherein:

said inplace assembly lies rearward of said insertable assembly, said insertion direction is a rearward direction, and said insertable assembly has a rear end; and said cam includes an elongated member that has a rearward end mounted on said housing at a location rearward of said inplace assembly and a forward end, said inplace connector has a through hole at its center and said forward end of said cam lies in said hole, so as the inplace assembly moves rearwardly said cam projects further through said hole, said cam follower having a cam engaging surface near the center of the rear end of said insertable assembly which engages said cam as the assemblies move rearward together.

* * * * *